US009814368B2

(12) United States Patent
Kang

(10) Patent No.: US 9,814,368 B2
(45) Date of Patent: Nov. 14, 2017

(54) DOORMAT DEVICE FOR CLEANING SHOE SOLE

(71) Applicant: Dong Hyun Kang, Busan (KR)

(72) Inventor: Dong Hyun Kang, Busan (KR)

( * ) Notice: Subject to any disclaimer, the term of this patent is extended or adjusted under 35 U.S.C. 154(b) by 780 days.

(21) Appl. No.: 14/278,217

(22) Filed: May 15, 2014

(65) Prior Publication Data

US 2015/0143645 A1 May 28, 2015

Related U.S. Application Data

(60) Provisional application No. 61/907,498, filed on Nov. 22, 2013.

(30) Foreign Application Priority Data

Jan. 15, 2014 (KR) ..... 10-2014-0005293

(51) Int. Cl.

| | |
|---|---|
| ***A47L 23/26*** | (2006.01) |
| ***A47L 23/28*** | (2006.01) |
| ***A47L 23/22*** | (2006.01) |
| ***A47L 23/02*** | (2006.01) |

(52) U.S. Cl.

CPC ..... *A47L 23/22* (2013.01); *A47L 23/02* (2013.01); *A47L 23/26* (2013.01); *A47L 23/28* (2013.01)

(58) Field of Classification Search

CPC ..... A47L 23/02; A47L 23/22; A47L 25/00; A47L 25/005; A47L 23/26; A47L 23/28

USPC ..... 15/97.2, 215, 216

See application file for complete search history.

(56) References Cited

U.S. PATENT DOCUMENTS

| | | | | |
|---|---|---|---|---|
| 3,589,635 | A | 6/1971 | Brueckheimer | |
| 5,771,528 | A * | 6/1998 | Nappi, Sr. | A47L 23/263 15/301 |
| 5,950,269 | A * | 9/1999 | Openshaw | A46B 13/001 15/34 |
| 7,051,393 | B2 * | 5/2006 | Cox | A61L 2/18 15/215 |

(Continued)

FOREIGN PATENT DOCUMENTS

| | | |
|---|---|---|
| CN | 202086451 | 12/2011 |
| DE | 3825617 A1 | 2/1990 |

(Continued)

OTHER PUBLICATIONS

Communication dated Nov. 2, 2016, issued by the State Intellectual Property Office of P.R. China in counterpart Chinese Application No. 201410225351.2.

*Primary Examiner* — Michael Jennings
(74) *Attorney, Agent, or Firm* — Sughrue Mion, PLLC

(57) ABSTRACT

The present disclosure provides an automatic doormat device for detecting and replenishing contaminated surface to keep contaminants from entering the house. An exemplary doormat device comprises a sticky sheet configured to adhesively pick up contaminants; a first roller configured to support windings of the sticky sheet; a second roller, spaced apart from the first roller, configured to wind the sticky sheet unwound from the first roller in rotation; a case configured to enclose the first roller and the second roller and support the sticky sheet on a portion exposed between the first roller and the second roller; and a drive motor configured to generate a driving force for rotating the second roller.

19 Claims, 6 Drawing Sheets

(56) References Cited

U.S. PATENT DOCUMENTS

| | | | | |
|---|---|---|---|---|
| 7,676,876 | B1 * | 3/2010 | Ewert | A47L 23/02 15/30 |
| 2008/0119810 | A1 * | 5/2008 | Kuroda | A61F 13/15707 604/379 |
| 2008/0131634 | A1 * | 6/2008 | Kiuchi | B32B 1/08 428/34.9 |
| 2010/0115717 | A1 * | 5/2010 | Vogt | A47L 23/263 15/4 |
| 2011/0252585 | A1 * | 10/2011 | Lee | A47L 23/02 15/30 |
| 2012/0042460 | A1 * | 2/2012 | Kessler | A47L 23/22 15/97.2 |
| 2012/0066847 | A1 * | 3/2012 | Bai | A47L 23/02 15/4 |
| 2012/0167338 | A1 * | 7/2012 | Williams | A47L 23/263 15/380 |
| 2014/0259459 | A1 * | 9/2014 | Ianchulev | A43D 25/06 12/18.1 |

FOREIGN PATENT DOCUMENTS

| | | | |
|---|---|---|---|
| EP | 0352780 | A2 | 7/1989 |
| JP | 6-169876 | A | 6/1994 |
| JP | 1997-253024 | A | 9/1997 |
| JP | 2002-065573 | A | 3/2002 |
| JP | 2002-078596 | A | 3/2002 |
| KR | 1020030048098 | A | 6/2003 |
| WO | 02/17768 | A2 | 3/2002 |

* cited by examiner

DOORMAT DEVICE FOR CLEANING SHOE SOLE

CROSS-REFERENCE TO RELATED APPLICATIONS

The present application is based on, and claims priority from, Korean Patent Application Number 10-2014-0005293, filed Jan. 15, 2014, which claims the benefit of priority to U.S. Provisional Patent Application No. 61/907,498, filed Nov. 22, 2013. The disclosures of above-listed applications are hereby incorporated by reference in their entireties for all purposes.

TECHNICAL FIELD

The present disclosure in some embodiments relates to a doormat device placed at the front door for cleaning shoe soles. More particularly, the present disclosure relates to a doormat device which provides a pressure-sensitive adhesive sheet and automatically replaces the adhesive sheet after a certain number of uses.

BACKGROUND

The statements in this section merely provide background information related to the present disclosure and may not constitute prior art.

To keep interior comfortable and clean, a doormat is placed at the entrance of house for removing dirt and dust of shoes that have been contaminated from outdoor activities.

At the entrance, the doormat provides a cleaning platform for shoe soles of an enterer to rub against, to remove contaminants such as dirt and dust adhering to the soles. Conventional doormats after prolonged and repeated uses turn into a source of contaminants that dirties the indoor floor.

Such contaminated mats need cleaning or replacement. To meet the need, devices have been provided for use in automatically cleaning mats or allowing manual replacements of adhesive sheets on the mat surfaces after the contaminants build up. However, such mat cleaning devices exact a complex structure and the mat thereof are usually difficult to clean after a long-time use. Further, in case of a manual device, it would be a big hassle for the user to manually replace the contaminated sheet.

SUMMARY

In accordance with at least one embodiment, the present disclosure provides a doormat device comprising a sticky sheet, a first roller, a second roller, a case and a drive motor. The sticky sheet is configured to adhesively pick up contaminants. The first roller is configured to support windings of the sticky sheet. The second roller, spaced apart from the first roller, is configured to wind the sticky sheet unwound from the first roller in rotation. The case is configured to enclose the first roller and the second roller and support the sticky sheet on a portion exposed between the first roller and the second roller. And the drive motor is configured to generate a driving force for rotating the second roller.

In addition, the doormat device may include a pressure sensor, a counter and a controller. The pressure sensor is configured to detect a pressure applied to the exposed portion of the sticky sheet so as to generate pressure information. The counter is configured to count events, an event comprising a detection of a pressure equal to or greater than a predetermined pressure threshold and a subsequent release of the pressure so as to generate a count information. The controller is configured to control the operation of the drive motor based on the pressure information and the count information.

In addition, the doormat device may include a count setting unit configured to set an event threshold of the number of counts generated by the counter of the at least one event, wherein the set event threshold equaled by the number of counts by the counter causes the controller to output a control signal for operating the drive motor.

In addition, the doormat device may include at least one sheet sensor connected to the controller for sensing the length of the exposed portion of the sticky sheet.

In addition, the doormat device according to the at least one embodiment may include an alarm unit configured to warn that the drive motor is in operation.

In addition, the doormat device may include a display unit provided on the case for displaying the number of counts by the counter.

In addition, the sticky sheet may have an underlayer formed of polyethylene (PET) or a non-woven fabric material.

In addition, the upper surface of the sticky sheet may be formed by including capsules of antimicrobial substances or fragrances.

The doormat device may further include a power cable and a cable slot. The power cable is configured to supply an electric power to the drive motor, the controller, the pressure sensor, the counter, the sheet sensor, the alarm unit and the display unit. The cable slot is formed along a first side of the case or a second side opposite to the first side for receiving the power cable.

The doormat device may further include a first cover and a second cover. The first cover is configured to define a first side enclosure for the first roller. The second cover is configured to define a second side enclosure for the second roller. Here, the first cover and the second cover are swivable to open and close the first side enclosure and the second side enclosure, respectively.

In accordance with another embodiment, the present disclosure provides a doormat device comprising a roller, a roller drive, a case and a power cable. The roller is configured to carry a sticky sheet having an adhesive surface for picking up contaminants. The roller drive is configured to expose an unused portion of the sticky sheet by rotating the roller if a predetermined operating condition is satisfied. The case is configured to enclose the roller and the roller drive. And the power cable is configured to supply an electric power to the roller drive.

The operating condition may be satisfied by counting at least one event comprising a detection of a pressure on the sticky sheet equal to or greater than a predetermined pressure threshold and a subsequent release of the pressure until an event count threshold is reached.

The sticky sheet may have an underlayer formed of polyethylene (PET) or a non-woven fabric material.

The upper surface of the sticky sheet may be formed by including capsules of antimicrobial substances or fragrances.

The doormat device may further include an alarm unit configured to warn that the drive motor is in operation.

The doormat device may further include a display unit provided on the case for displaying the number of counts of the roller drive of at least one event comprising a detection of a pressure on the sticky sheet equal to or greater than a predetermined pressure threshold and a subsequent release of the pressure.

The doormat device may further include a cable slot formed along a side of the case for receiving the power cable.

The doormat device may further include a pair of covers configured to define opposite side enclosures so that the covers are swivable to open and close the opposite side enclosures, respectively.

DETAILED DESCRIPTION OF EXEMPLARY EMBODIMENTS

Figure 1:
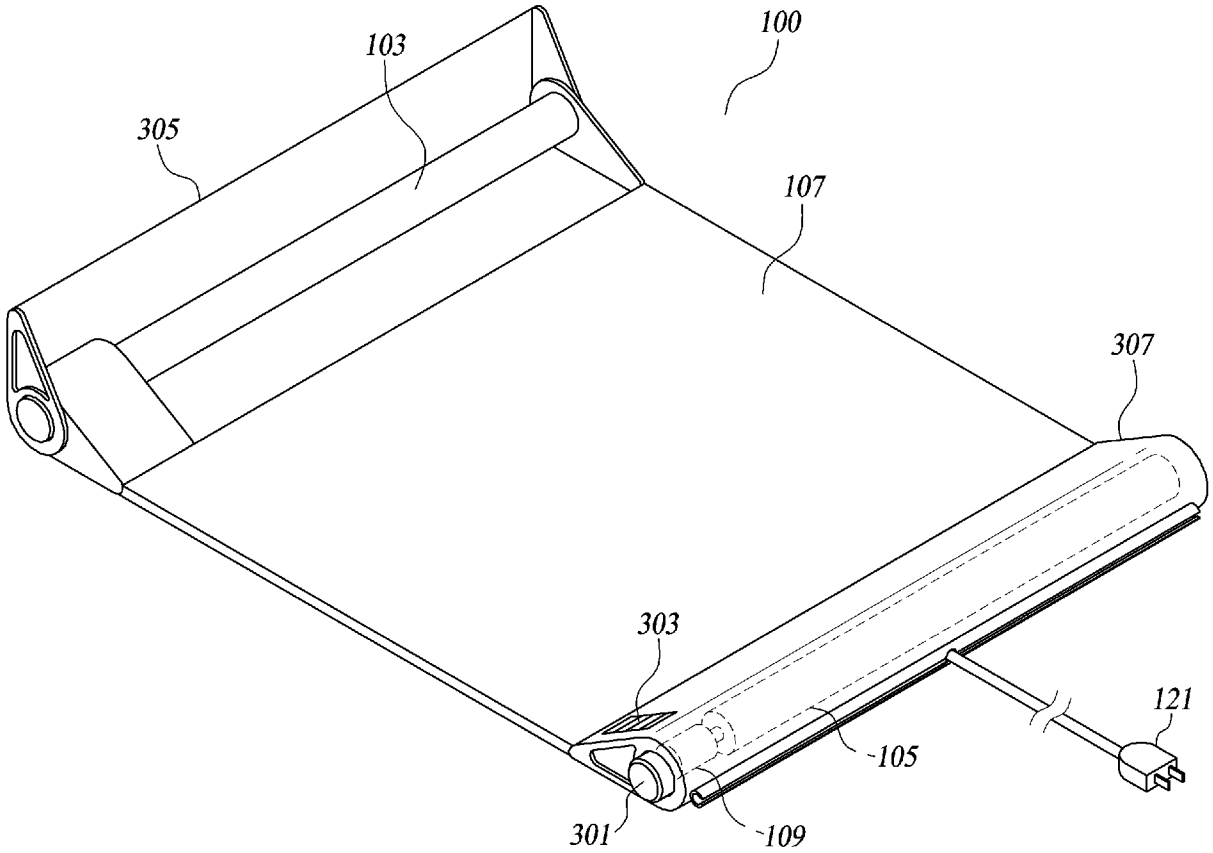
FIG. 1 is a general perspective view of a doormat device according to at least one exemplary embodiment of the present disclosure.

At least one embodiment of the present disclosure provides a doormat device with a web of sticky sheet replenished automatically by a portion after a certain number of uses without a manual involvement, whereby preventing outdoor contaminants from entering indoors.

Hereinafter, some embodiments of the present disclosure will be described in detail with reference to the accompanying drawings. In the following description, like reference numerals designate like elements, although the elements are shown in different drawings. Further, in the following description of the at least one embodiment, a detailed description of known functions and configurations incorporated herein will be omitted for the purpose of clarity and for brevity.

Figure 2:
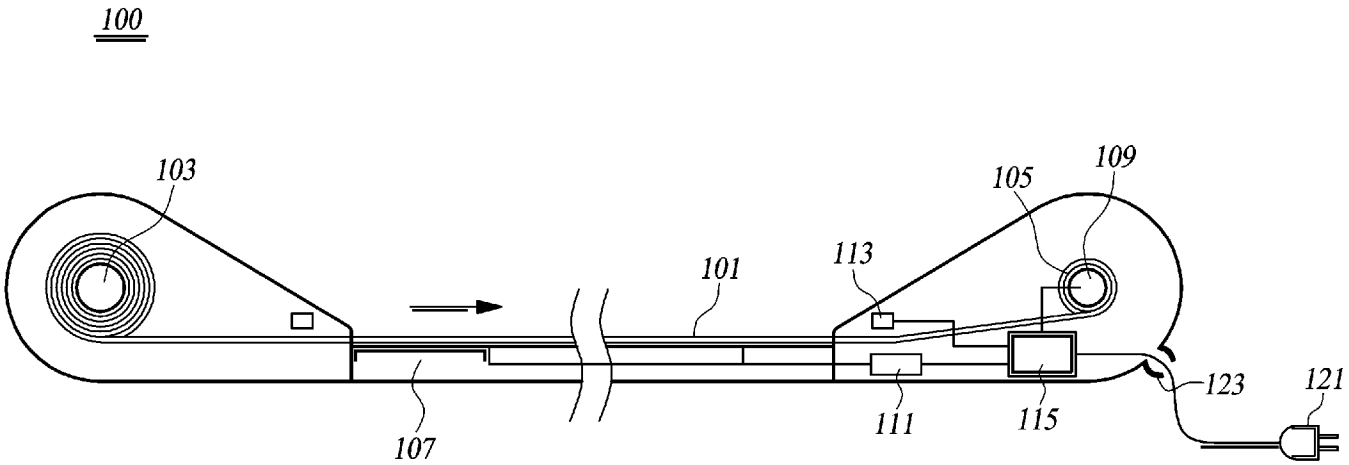
FIG. 2 is a cross sectional view of the doormat device according to the at least one exemplary embodiment.

FIG. 1 is a general perspective view of a doormat device according to a first exemplary embodiment of the present disclosure; FIG. 2 a longitudinal sectional view of a doormat device according to the first exemplary embodiment; and FIG. 3 a block diagram of a control module installed in the doormat device according to the first embodiment.

A pressure-sensitive adhesive sheet or sticky sheet 101 serves on its adhesive upper surface to attract contaminants from shoe soles. To make the upper surface of sticky sheet 101 sticky, it may have an adhesive agent applied or have formations of fine protrusions under which contaminants adhere and contained. Sticky sheet 101 may have an underlayer formed of PET or polyethylene material, and it may have an inlay formed of a non-woven fabric material to absorb moisture. However, the present disclosure is not limited thereto, and may include any substances for use as the base material of the adhesive agent without being restricted to a particular type.

The upper surface of sticky sheet 101 may be formed of a double overlayer having a top tier with an adhesive strength and a bottom tier with embedded microcapsules of antimicrobial substances or fragrances. In the use case where the user steps on the upper surface of sticky sheet 101, the depression results in bursting of the microcapsules which in turn causes the leakage of the internal substances with the antimicrobial agents and/or the fragrances. The capsules of antimicrobial agent and/or fragrance may be in the form of microcapsules having such a size and shape as not to interfere with winding of sticky sheet 101 into a roll. Sticky sheet 101 is wound around a core which is rotatable to dispense a length of sticky sheet 101. The core herein refers to a roll core for holding sticky sheet 101 wound thereon.

A first roller 103 is adapted to unroll sticky sheet 101. A fresh roll of cored sticky sheet 101 is loaded on first roller 103. Corotating with first roller 103, sticky sheet 101 may be partially unrolled away from the roll core. Expanding and shrinking of first roller 103 facilitates mounting and ejecting thereof from a holder or case 107, and sticky sheet 101 may be replaced by threading first roller 103 in the roll core with fresh sheet 101 wound thereon. Herein, the expanding and shrinking mean a property of first roller 103 to expand and contract in its longitudinal direction. For example, when taking out first roller 103 to exchange sticky sheets, first roller 103 may contract in the longitudinal direction by an external force so that it is ejected from case 107 when first roller 103 returns longitudinally to its full length.

The doormat device has a second roller 105 which is spaced apart from first roller 103 and parallel to first roller 103 for winding sticky sheet 101 roll out from first roller 103 as it rotates. Since second roller 105 is arranged spaced in parallel from first roller 103, a cycle of interoperation of first and second rollers 103, 105 exposes a fresh sticky sheet 101 by a length equal to the space between the rollers 103 and 105. After picking up contaminants on the bottom of a shoe, the exposed sticky sheet 101 is wound around the outer circumference of second roller 105. Therefore, the unused portion of sticky sheet 101 remains wound about the roll core mounted on first roller 103 and sticky sheet 101 used in adhering contaminants is wound on the outer peripheral surface of second roller 105. An elasticity of second roller 105 for easily ejecting thereof from an enclosure or case 107 allows used sticky sheet 101 to be drawn out along with the supporting second roller 105 and then removed therefrom. The elasticity herein means the same as that of first roller 103.

The structure and functions of first and second rollers 103, 105 for unwinding and winding sticky sheet 101 respectively, are not limited to the above description and those of the two rollers may be switched as needed.

Case 107 forms one space on a first side for housing first roller 103 and another space on a second side for housing second roller 105 and has a floor adapted to support sticky sheet 101 exposed between two rollers 103 and 105. Therefore, case 107 is configured to enclose multiple components included in the doormat device. Here, the first side refers to one lateral area of case 107 where first roller 103 is accommodated and the second side refers to the opposite lateral area of case 107 where second roller 105 is accommodated. The first side housing first roller 103 is provided with a first cover 305, and the second side housing second roller 105 is provided with a second cover 307. First and second covers 305, 307 are swivable up and down. This configuration provides enclosed spaces on both of the first and second sides of case 107, which may be opened to allow replacements of sticky sheet 101. First and second covers 305, 307 may be arbitrarily shaped to facilitate the replacement of sticky sheet 101.

Case 107 may be formed by the assembly of three separable parts which are the floor for supporting the exposed sticky sheet 101, the first side housing first roller 103 and the second side housing second roller 105.

The doormat device has a drive motor unit 109 for providing a rotational torque for first roller 103 or second roller 105. However, assuming the arrangement according to the present embodiment where sticky sheet 101 is wound around the outer peripheral surface of second roller 105, drive motor 109 may be connected to second roller 105 for rotatably driving the same. However, the adhesive strength of sticky sheet 101 may resist a smooth rotation of the nonmotorized first roller 103 to obstruct the unwinding of sticky sheet 101. Therefore, for the sake of a smoother rotational operation, each of first roller 103 and second roller 105 may have drive motor 109 connected thereto.

The doormat device has a pressure sensor unit 111 for detecting a pressure applied on the exposed sticky sheet 101. Pressure sensor 111 can sense the pressure and inform the pressure to a controller 205. Pressure sensor 111 is adapted to monitor a portion of case 107 for detecting the presence of the user on sticky sheet 101 although it may be configured on a variety of other methods for recognizing the user stepping on sticky sheet 101. To this end, at least two of pressure sensor 111 may be installed towards the open area where sticky sheet 101 is exposed to detect the user on the sheet.

An alarm unit 113 is provided to inform the user of the operating state of drive motor 109. The mal-operation of drive motor 109 for the replacement of used stick sheet 101 may occur upon a false detection of the user or the user's inadvertent stepping on the same sticky sheet 101. Such mal-operation possibly do a damage to the device or the user. Therefore, alarm unit 113 is employed to receive signals input from controller 205 and allow the user to recognize the operation state of drive motor 109.

Alarm unit 113 may be configured to emit light such as red light for indicating drive motor 109 in active state and green light for inactive drive motor 109. Alternatively, alarm unit 113 may be formed as a beeper for audibly warning the user.

Figure 3:
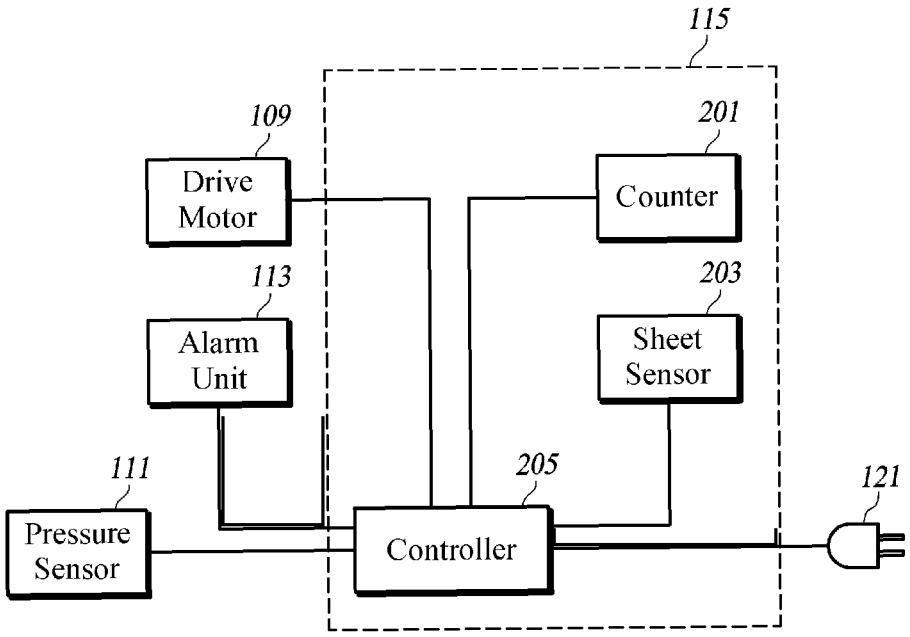
FIG. 3 is a block diagram of a control module installed in the doormat device according to at least one exemplary embodiment.

FIG. 3 illustrates the control module 115 that coordinates and controls the overall operation of doormat device 100. Control module 115 includes a counter 201, a sheet sensor 203 and the controller 205 and is electrically connected to pressure sensor 111 and alarm unit 113 for carrying out the overall control of doormat device 100. The following description will detail the operation of each unit included in control module 115.

Based on the pattern of pressures sensed by pressure sensor 111, counter 201 determines whether doormat device 100 is used by the user. If it is determined as used, counter 201 counts the number of uses to generate and transmit count data to controller 205. For example, upon detection of a pressure above a threshold caused by the user stepping on sticky sheet 101, counter 201 counts one time of use of doormat device 100 in response to a release of pressure as the user steps down from sticky sheet 101 with the shoes decontaminated. Here, repetitive stepping on and off or brushing shoes against sticky sheet 101 after the detection of the above-threshold pressure caused by the user stepping on sticky sheet 101 will not increase the count, but an immediately subsequent release of the pressure and in turn no detection thereof will complete a count. On the other hand, the range of effective pressures detectable for indicating the presence of the user on sticky sheet 101 may be set at 10 kg or more with respect to the area of the exposed sticky sheet 101. However, if a child user is involved, the threshold pressure can be set to a lower value.

Sheet sensor 203 is for detecting a length of sticky sheet 101 which is exposed between first roller 103 and second roller 105. The at least partial contaminated length of the exposed sticky sheet 101 may need a replenishment. Therefore, sheet sensor 203 can sense the exposed length of sticky sheet 101 and accordingly generate and transmit length data to controller 205.

An exemplary method of sheet sensor 203 for detecting the exposed contaminated length of sticky sheet 101 is to measure the time and speed of the sticky sheet passing sheet sensor 203 and then the displacement of sticky sheet 101 in the corresponding speed to eventually determine the exposed length of sticky sheet 101. For more accurate measurement, a plurality of sheet sensors 203 may be deployed to measure the exposed length of sticky sheet 101. For example, each sheet sensor 203 may be provided on the first side of case 107 for housing first roller 103 and on the second side for housing second roller 105 in order to measure more accurate time and speed of sticky sheet 101 passing by sheet sensors 203 on both sides. In an alternative arrangement, the replenishment of sticky sheet 101 is performed by exposing a predetermined length of sticky sheet 101 without resort to utilizing sheet sensors 203. Drive motor 109 may be adapted to operate, for example, based on premeasured variations in the displacement of sticky sheet 101 in relation to the rotations of second roller 105.

Controller 205 is for operating the driving the motor 109 by using the pressure and count data. Controller 205 is responsive to an increase of the counts of counter 201 reaching a set threshold for transmitting a control signal to drive motor 109 so as to operate the same. Further, upon operating drive motor 109, controller 205 may initialize the number of counts by counter 201. The control signal for controlling drive motor 109 may be varied to redetermine the length of replenishment of sticky sheet 101 based on the sensed data from sheet sensor 203. Control signals for controlling the drive motors 109 for these can be changed to different in length exchange sensitive adhesive sheet 101 based on the information detected by the sheet sensor 203. Doormat device 100 of the present disclosure includes a count setting unit 301 which will be described later.

Depending on whether drive motor 109 is in operation or not, controller 205 may control either alarm unit 113 or display unit 303, the operation of which will be described later. For example, when drive motor 109 operates, controller 205 can send the control signal to alarm unit 113 to activate the same. In response to receipt of increased count from counter 201, controller 205 sends the control signal to display unit 303 for presenting the user with a display of the number of counts. In addition, as the presence of the user on sticky sheet 101 is detected by pressure sensor 111, controller 205 keeps drive motor 109 from operation even if counter 201 counts up to the set threshold.

Count setting unit 301 is adapted to set the threshold of the number of counts by counter 201 for triggering the operation of drive motor 109. The user can have the option of setting the frequency of replenishing sticky sheet 101 in response to changes in the external environment. For example, if shoes are less contaminated thanks to fine weather, the user can set a higher threshold of the number of counts. On the other hand, in case of precipitation or other elements of weather expected to soil the shoes more, the threshold of the counts by counter 201 can be set lower to meet the need to replenish sticky sheet 101 more frequently. In this way, count setting unit 301 may be adjusted to set the threshold of the usage counts at which sticky sheet 101 is replenished automatically. For example, when the user sets the threshold of usage counts to three by using count setting unit 301, three times of usage of sticky sheet 101 will automatically replace the same. Such count setting unit 301 includes, but not limited, to the form of a dial knob or a button and a display combined.

Display unit 303 is adapted to display information on the counts by the counter 201. As the count threshold in counter 201 operates drive motor 109, display unit 303 offers a display of the current count information to the user. Display unit 303, when necessary, displays the threshold count set by count setting unit 301. Display unit 303 may be a bar-shaped display provided on the outer surface of case 107.

Figure 4:
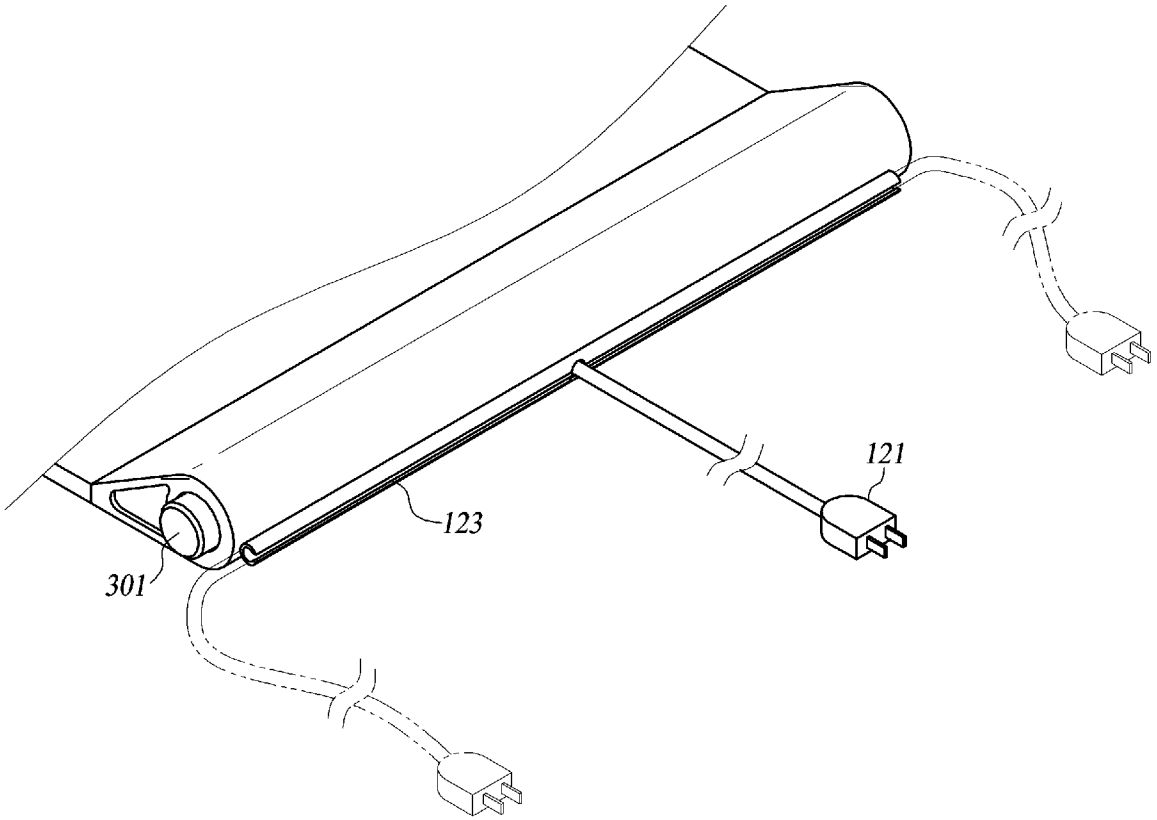
FIG. 4 is a partial perspective view of a doormat device according to at least one exemplary embodiment.

FIG. 4 is a partial perspective view of a doormat device according to the first exemplary embodiment of the present disclosure.

A power cable 121 is provided to supply power for operating the doormat components including drive motor 109, controller 205, pressure sensor 111, counter 201, sheet sensor 203 and alarm unit 113. Power cable 121 is connected to an external power source. Meanwhile, doormat device 100 is normally placed at a main entrance, while the location of utility outlet around by the main entrance is more likely to be varied according to specific building structures. In view of this, power cable 121 may be held in varying locations to adapt to the placement of the outlet. To this end, case 107 has at least one cable slot 123 formed on and extending from either end of case 107 to cross power cable 121 which is illustrated as protruding from midway along a side of case 107. This arrangement provides a neat management of power cable 121 by relocating thereof in either direction. Cable slot 123 securely leads power cable 121 in either direction suitable to the placement of an outdoor outlet.

Figure 5:
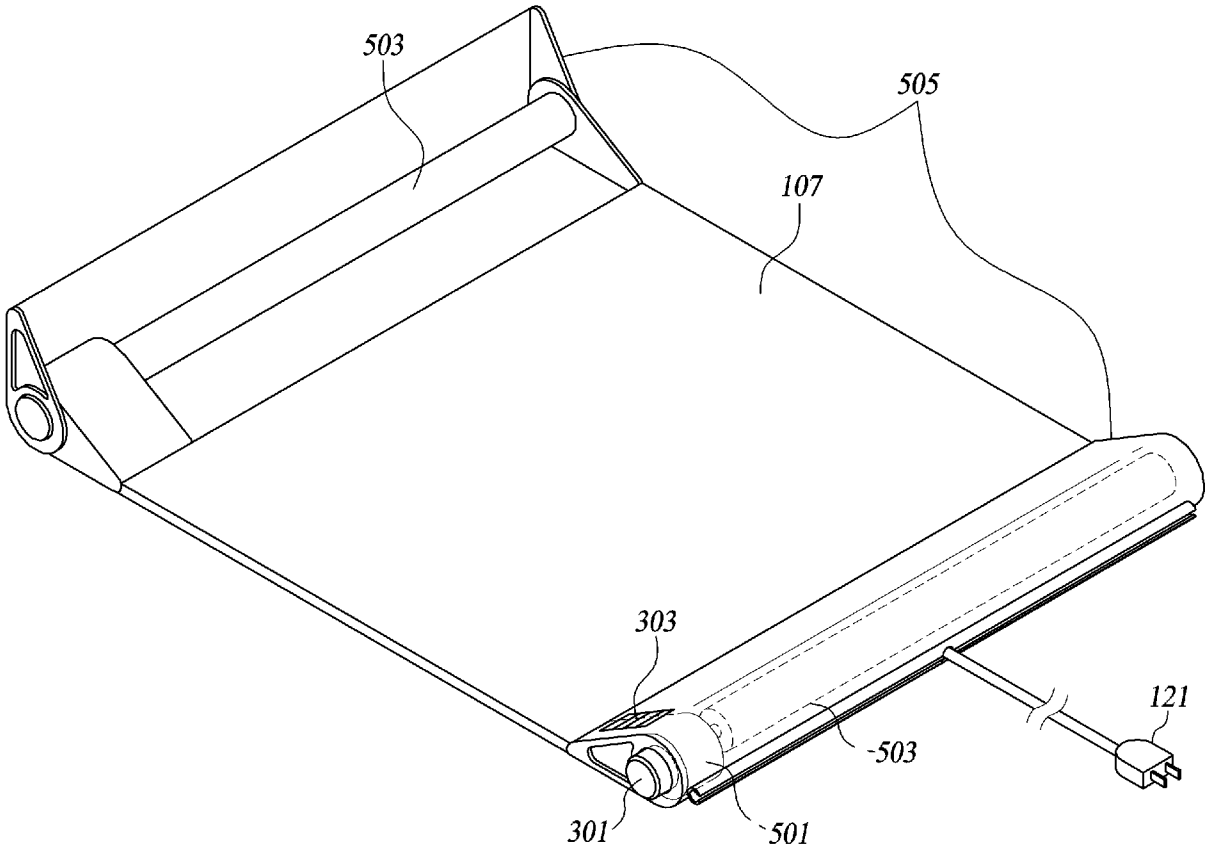
FIG. 5 is a perspective view of a doormat device according to at least one exemplary embodiment.
Figure 6:
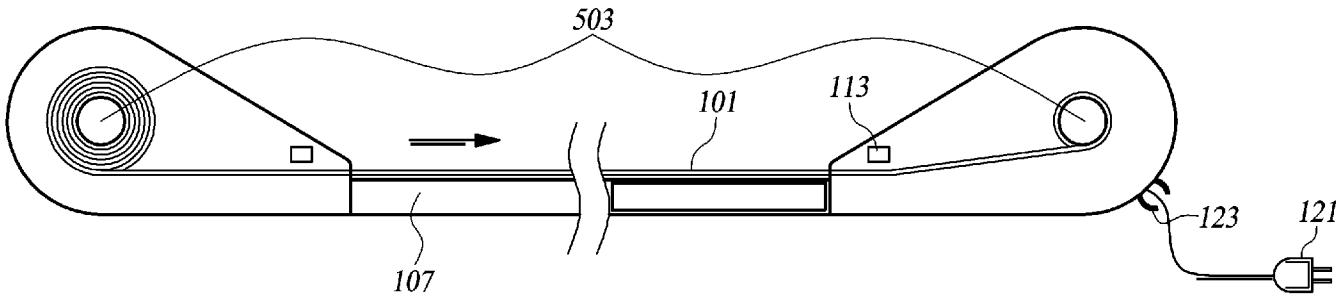
FIG. 6 is a cross sectional view of the doormat device according to at least one exemplary embodiment.

FIG. 5 generally illustrates the doormat device according to a second embodiment in perspective view, and FIG. 6 is a longitudinal sectional view of the doormat device of the second exemplary embodiment.

In the following description, a detailed description as aforementioned with reference to FIGS. 1 to 4 will be omitted for the purpose of clarity and brevity.

The doormat device in this embodiment has a roller drive 501 adapted to rotate at least one of two opposite rollers 503 if a predetermined operating condition is met. An example of the predetermined condition is counting at least one event comprising a detection of a pressure on the sticky sheet 101 equal to or greater than a predetermined pressure threshold and a subsequent release of the pressure until an event count threshold is reached, whereby rotating roller 503. Other details of the pressure and the number of counts with respect to the thresholds are similar to or the same as for the pressure and count information as described above.

Roller drive 501 is connected to one or both of rollers 503 to provide a rotational force to the same. Roller drive 501 detects the pressure applied onto sticky sheet 101, counts the event of the pressure detection followed by a release of the pressure and sets a threshold of the event count. Therefore, in order to rotate roller 503 with certain operational condition met, roller drive 501 may include the aforementioned component units, including drive motor 109, pressure sensor 111, counter 201, sheet sensor 203, controller 205 and count setting unit 301 among other various units which assist the operation of roller drive 501.

Roller 503 is identical or similar to the aforementioned first roller 103 and second roller 105 in configuration and functionality. Covers 505 correspond structurally and functionally to first and second covers 305, 307 of the doormat device according to the first embodiment.

According to the present disclosure as described above, the contaminated sticky sheet is automatically replenished without a user's manual involvement to keep interior clean conveniently.

Although exemplary embodiments of the present disclosure have been described for illustrative purposes, those skilled in the art will appreciate that various modifications, additions and substitutions are possible, without departing from the various characteristics of the disclosure. Therefore, exemplary embodiments of the present disclosure have been described for the sake of brevity and clarity. Accordingly, one of ordinary skill would understand the scope of the disclosure is not limited by the explicitly described above embodiments but by the claims and equivalents thereof.

What is claimed is:

1. A doormat device, comprising:

a sticky sheet having an adhesive surface;

a first roller configured to support a winding of the sticky sheet;

a second roller, spaced apart from the first roller, configured to wind the sticky sheet unwound from the first roller in rotation;

a case configured to enclose the first roller and the second roller and support the sticky sheet on a portion exposed between the first roller and the second roller;

a drive motor configured to generate a driving force to rotate the second roller; and a controller configured to control an operation of the drive motor based on a result of counting an event comprising a detection of a pressure on the sticky sheet equal to or greater than a predetermined pressure and a subsequent release of the pressure.

2. The doormat device of claim 1, further comprising:

a pressure sensor configured to detect a pressure applied to the exposed portion of the sticky sheet to generate pressure information; and a counter configured to count the event comprising the detection of the pressure equal to or greater than the predetermined pressure and the subsequent release of the pressure to generate count information.

3. The doormat device of claim 2, further comprising a count setting unit configured to set a threshold of a number of the event counted by the counter, wherein the controller is further configured to output a control signal to operate the drive motor, in response to the number of the event counted by the counter being equal to the threshold.

4. The doormat device of claim 2, further comprising at least one sheet sensor connected to the controller and configured to sense a length of the exposed portion of the sticky sheet.

5. The doormat device of claim 1, further comprising an alarm unit configured to signal that the drive motor is in operation.

6. The doormat device of, claim 5 further comprising a display unit provided on the case and configured to display a number of the event counted by a counter.

7. The doormat device of claim 6, further comprising: a power cable configured to supply power to at least one of the drive motor, the controller, the counter, the alarm unit and the display unit; and a cable slot formed along a first side of the case or a second side opposite to the first side and configured to receive the power cable.

8. The doormat device of claim 1, wherein the sticky sheet comprises at least one of an underlayer formed of polyethylene (PET) and a non-woven fabric material.

9. The doormat device of claim 8, wherein the sticky sheet has an upper surface on which at least one capsule containing at least one of an antimicrobial substance and a fragrance is provided.

10. The doormat device of any one of claim 1, further comprising:

a first cover configured to define a first side enclosure corresponding to the first roller; and a second cover configured to define a second side enclosure corresponding to the second roller, wherein the first cover and the second cover are swivable to open and close the first side enclosure and the second side enclosure, respectively.

11. A doormat device, comprising: a roller configured to carry a sticky sheet having an adhesive surface;

a roller drive configured to expose an unused portion of the sticky sheet by rotating the roller in response to a predetermined operating condition being satisfied:

a case configured to enclose the roller and the roller drive; and a power cable configured to supply power to the roller drive;

and a pair of covers configured to define opposite side enclosures of the doormat device, the covers being swivable to open and close the opposite side enclosures, respectively.

12. The doormat device of claim 11, wherein the operating condition is satisfied when a count number, which is generated by counting an event comprising a detection of a pressure on the sticky sheet equal to or greater than a predetermined pressure and a subsequent release of the pressure is equal to a threshold.

13. The doormat device of claim 12, wherein the sticky sheet comprises at least one of an underlayer formed of polyethylene (PET) and a non-woven fabric material.

14. The doormat device of claim 11, wherein the sticky sheet comprises at least one of an underlayer formed of polyethylene (PET) and a non-woven fabric material.

15. The doormat device of claim 14, wherein the sticky sheet has an upper surface on which at least one capsule containing at least one of an antimicrobial substance and a fragrance is provided.

16. The doormat device of claim 11, further comprising an alarm unit configured to signal that the roller drive is in operation.

17. The doormat device of claim 11, further comprising a display unit provided on the case and configured to display a number of counts generated by counting an event comprising a detection of a pressure on the sticky sheet equal to or greater than a predetermined pressure and a subsequent release of the pressure.

18. The doormat device of claim 11, further comprising a cable slot formed along a side of the case and configured to receive the power cable.

19. A doormat device, comprising:

a roller that carries a sticky sheet having an adhesive surface;

a controller configured to perform detection, a certain number of times or greater, of a pressure on the sticky sheet equal to or greater than a predetermined pressure and a subsequent release of the pressure;

a roller drive configured to expose an unused portion of the sticky sheet by rotating the roller according to a result of the detection by the controller and a case configured to enclose the roller and the roller drive.

* * * * *